US006506337B2

(12) United States Patent
Sieradzki

(10) Patent No.: US 6,506,337 B2
(45) Date of Patent: Jan. 14, 2003

(54) MOLTEN METAL LADLE TRANSPORT ARRANGEMENT

(75) Inventor: Christopher Z. Sieradzki, Monee, IL (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/827,156

(22) Filed: Apr. 6, 2001

(65) Prior Publication Data

US 2002/0145237 A1 Oct. 10, 2002

(51) Int. Cl.[7] ..... C21B 7/22
(52) U.S. Cl. ..... 266/144; 266/276
(58) Field of Search ..... 266/143, 144, 266/287, 276

(56) References Cited

U.S. PATENT DOCUMENTS 4,199,350 A * 4/1980 Kutscher et al. ..... 75/46
4,825,772 A * 5/1989 Jeffreys ..... 104/247
5,480,127 A * 1/1996 Choudhury et al. ..... 266/143

* cited by examiner

*Primary Examiner*—Scott Kastler
(74) *Attorney, Agent, or Firm*—Edward J. Brosius

(57) ABSTRACT

An arrangement of operating stations and equipment for the rapid preparation and transport of molten metal ladles and pouring tanks with covers to a pouring station of a pressure-pouring operation, and a method of providing the moving, placement and transport of the ladles and pouring tanks for the minimization of the loss of time between end of the first stage of pouring and initiation of the second stage of pouring.

2 Claims, 1 Drawing Sheet

MOLTEN METAL LADLE TRANSPORT ARRANGEMENT

BACKGROUND OF THE INVENTION

The present invention is directed to method and apparatus for moving molten metal ladles between a cover position, a ladle-load position and a pouring position at a casting station. More particularly, a method and an apparatus are taught which enhance a pressure casting process to expedite the movement from the pouring station of a molten-metal evacuated ladle and the positioning of a molten-metal filled ladle at the pouring station without the intermediate delays associated with ladle covering and uncovering.

Casting and casting practices generally involve the use of molten metals at elevated temperatures. This molten metal practice requires the use of heavy apparatus for the holding and transport of the metal. Specifically, molten metal for casting is frequently held in large steel or cast-iron ladles lined with refractory brick. In a pressure-casting or pouring operation, the ladle is placed in a pouring tank and a tank cover is placed atop the pouring tank. This tank cover is equipped with a pouring tube as well as ports to elevate the gas pressure above the molten metal. Avoidance of fracture of the pouring tube and refractory linings generally involves maintaining or preheating the pouring tank cover and pouring tube. A holding or heating furnace is frequently utilized for this purpose. However, the physical act of positioning the pouring tank cover atop the pouring tank and thereafter securing the pouring tank cover are time-consuming operations and an inhibition to a rapid production operation.

A presently known operation utilizes a single pouring or casting station in cooperation with twin ladle-loading stations. These ladle-loading stations use pressure-pouring tanks on transfer cars for holding the hot-metal ladles, and for transporting the ladles between the ladle-loading stations and the pouring station. In this operation, a ladle of molten metal is transported to a pressure-pouring tank at a ladle-loading station for subsequent transfer of the ladle containing pouring tank to the pouring station. At the pouring station, a pressure-pouring tank cover is positioned on and secured to the pressure pouring tank by the pouring crane. After pouring of the molten metal from the ladle, the pressure pouring tank cover is removed using the pouring crane. The pressure pouring tank is then transported to the first ladle-loading station for eventual filling with another ladle of molten metal. A second molten-metal-filled ladle in a pressure pouring tank is then transported to the pouring station from the second ladle-loading station and a pressure pouring tank cover is positioned and secured to the second pressure pouring tank at the pouring station, as described above.

The time delays in pressure pouring tank covering and the use of the pouring crane at the pouring station are significant when measured in terms of daily lost production of large castings. Accordingly, it is an object of the present invention to provide a more efficient pressure pouring arrangement.

SUMMARY OF THE INVENTION

The present invention provides a method and apparatus to provide a more efficient arrangement for bottom-pressure casting. In this method, the pressure pouring tank cover is secured on a first pressure pouring tank at a ladle-load station prior to moving the covered pressure pouring tank with a full ladle into the pouring-station position. Further, subsequently but prior to the emptying of the first ladle, a second metal-filled ladle in a second pressure pouring tank is positioned in a second ladle-load station with its pressure pouring tank cover secured. The second covered pressure pouring tank is ready for immediate movement into the pouring station after emptying of the first ladle and the removal of the first pouring tank from the pouring station without removal of the first pressure pouring tank cover. The pressure pouring tank covers are moved onto the pouring tanks at the ladle-load stations by a jib crane or overhead crane. The pressure pouring tank covers with their pouring tubes are maintained at an elevated temperature at cover station ovens within the range of motion of the jib crane or overhead crane. The second pressure pouring tank is available for immediate placement into the pouring station to continue production as soon as the first pressure pouring tank with its empty ladle has been moved a distance adequate to provide the necessary clearance for the second pressure pouring tank transfer-car bearing a second metal-filled ladle.

DESCRIPTION OF THE PREFERRED EMBODIMENT

Known bottom-pressure casting practice in the industry utilizes a two-ladle-load-station practice to transfer molten-metal filled ladles to a single pouring station, which practice was considered an improvement over the older practice of a single pouring station and a single ladle-load station. It is recognized that molten metal is provided from steel manufacturing furnaces, such as basic oxygen furnaces or electric arc furnaces, which furnaces and furnace practice are known but not shown.

This casting process is directed to the bottom-pressure pouring and casting of railroad wheels. The railroad wheels are steel castings weighing upwards of six hundred pounds and produced from molten steel poured at about 2900° F.

Figure 1:
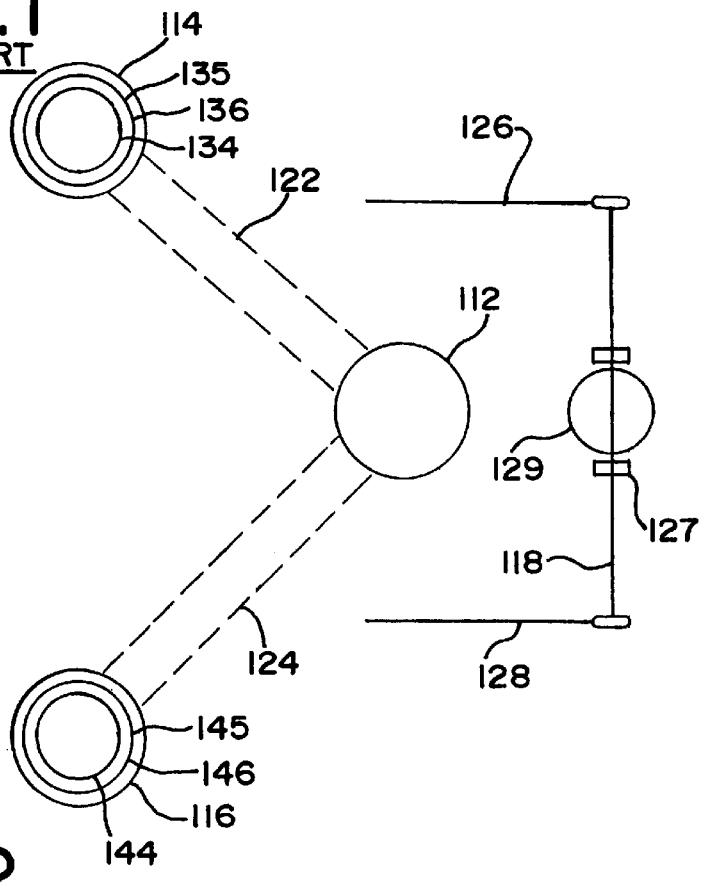
FIG. 1 PRIOR ART
FIG. 1 is a schematic outline of the locations of the pressure pouring tank positions of the prior art practice.

Referring now to FIG. 1, a prior art bottom pressure casting pouring station with two ladle-loading stations is shown.

The single pouring station is shown at 112, with track 122 leading to ladle-loading station 114 and track 124 leading to ladle-loading station 116. Pouring crane 127 is seen to move laterally along bridge 118 which itself moves transversely along support rails 126, 128.

In a known pouring operation utilizing the prior art arrangement of FIG. 1, ladle 134 of molten metal is placed in pouring tank 135 in tank transfer car 136 at ladle-loading station 114. Tank transfer car 136 is rolled across track 122 into pouring station 112.

Pouring tank cover 129 is then placed on pouring tank 135 utilizing pouring crane 127. Pouring tank cover 129 is kept in a holding oven located transversely from pouring station 112 within support rails 126, 128.

When ladle 134 is empty, pouring crane 127 is utilized to remove pouring tank cover 129. Pouring tank transfer car 136 is then rolled out of pouring station 112 back to ladle-loading station 114.

Another pouring tank transfer car 146 with pouring tank 145 on it and with fill ladle 144 within pouring tank 145 has been prepared at ladle-loading station 116. Tank transfer car 146 is rolled across track 124 into pouring station 112. Another pouring tank cover identical to cover 129 is then placed on pouring tank 145 utilizing pouring crane 127. Pouring tank cover 129 is left in a holding oven located transversely from pouring station 112 within support rails 126, 128.

Positioning pouring tank cover 129 over pouring tank 135 at pouring station 112 generates a delay in initiating actual casting of railroad wheels. It is estimated that this delay can be between eight and 10 minutes. In a casting practice manufacturing one casting per minute, this is considered a significant time loss when placed in the context of approximately forty-five ladles of molten steel being poured per day.

Figure 2:
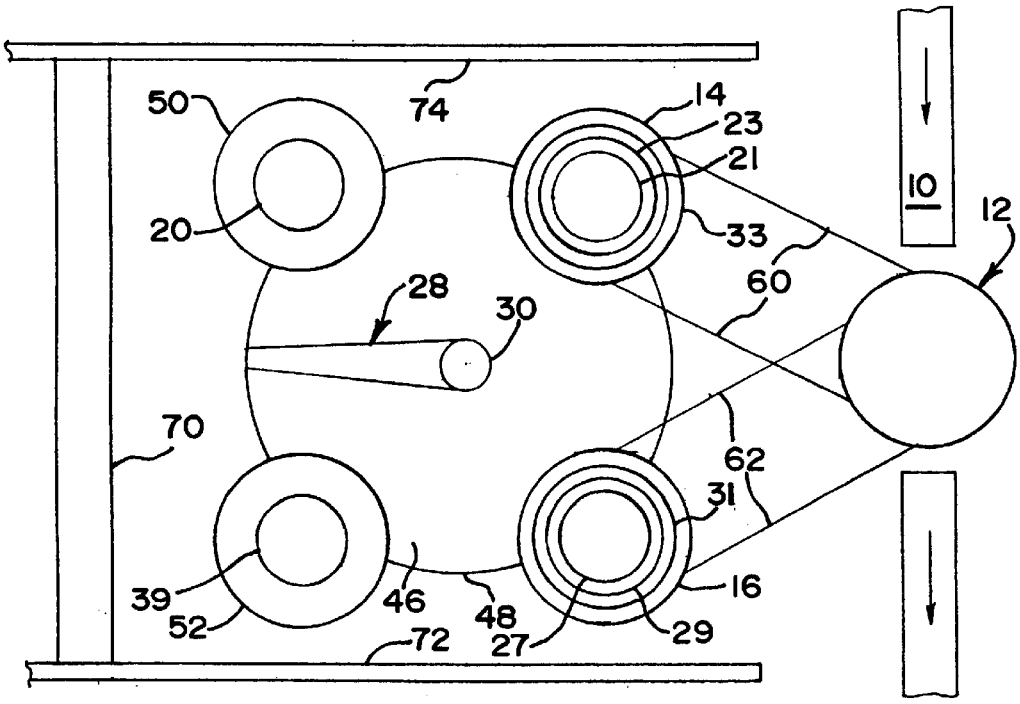
FIG. 2 is a schematic plan view of the locations of the several positions for the pressure pouring tanks of the present invention.

In FIG. 2, an arrangement in accordance with the present invention is shown. Pouring station 12 is operatively connected to ladle-load-stations 14 and 16 by tracks 60 and 62. Jib crane 28 with center pivot 30 is located between, and offset from, ladle-loading stations 14 and 16. In this configuration, jib crane 28 may be rotated about center 30 and extends over ladle-loading stations 14 and 16. Alternatively, overhead crane 70 along tracks 72, 74 can be utilized to transfer ladles from ladle-loading stations 14, 16 to pouring station 12 and pouring tank covers to and from cover holding ovens 50, 52 to ladle-loading stations 14, 16.

First pouring tank cover holding oven 50 and second pouring tank cover holding oven 52 are displaced from pouring station 12, as well as ladle-load stations 14 and 16. Pouring tank cover holding ovens 50 and 52, and ladle-load stations 14 and 16 are symmetrically arranged, but this is merely illustrative and not a limitation. Pouring tank cover 20 and its pouring tube are preheated to avoid thermal shock at introduction of the pouring tube into a molten metal in ladle 21. Jib crane 28 or overhead crane 70 is operable to grasp pouring tank cover 20 from either of pouring tank cover ovens 50 and 52, and to move pouring tank cover 20 over either pouring tank 23 or 29 at ladle-load station 14 or 16.

In an illustrative operation, a pressure-pouring tank transfer car 33 with a molten-metal filled ladle 21 in pouring tank 23 is positioned at ladle-load station 14 in preparation for transfer to pouring station 12. Pouring tank 23 with ladle 21 therein will have pouring tank cover 20 positioned and secured thereon with a pouring tube extending into molten metal bath in ladle 21 by the use of jib crane 28 or overhead crane 70. Thereafter, pouring tank 23 is transferred to pouring station 12 on transfer car 33 over rails 60 for continuation of the casting operation.

After casting the metal in ladle 21 at pouring station 12, evacuated ladle 21 and transfer tank car 33 are returned to ladle-load station 14 for removal of pouring tank cover 20. Simultaneously, a full ladle 27 in pouring tank 29 covered with pouring tank cover 39, having been installed by jib crane 30 or overhead crane 70, has been readied at second ladle-load station 16. Covered pouring tank 29 at second ladle-load station 16 is then moved into position at pouring station 12 along tracks 62 on second transfer car 31 as soon as first transfer car 33 has moved a distance from station 12 adequate to provide clearance to pouring station 12 for second tank transfer car 31.

It can be appreciated that the covering and uncovering of pouring tank 22 is now conducted at ladle-load stations 14 and 16 instead of pouring station 12, which greatly lessens the interruption of pouring operations at pouring station 12. For example, the total turnaround time for transfer of a ladle 134 with the transfer system of the prior art required eight to ten minutes with the above-described ladle handling procedure at pouring station 112. With the present invention and use of ladle-load stations 14 and 16 and holding ovens 50, 52, the calculated time for removal of pouring tank 23 with ladle 21 from pouring station 12 and the placement of covered pouring tank 29 from ladle-load station 16 to pouring station 12 is three minutes, a saving of at least five minutes.

What is claimed is:

1. A method of pouring molten metal from a ladle, said method comprising:

placing a first ladle of molten metal in a first pouring tank and placing a first cover from a holding oven on said first pouring tank at a first ladle loading station, transferring said first pouring tank with said first ladle and said second pouring truck cover to a pouring station, pouring said molten metal from said first ladle, and before said first ladle is emptied of said molten metal, placing a second ladle of molten metal in a second pouring tank and placing a second cover from said holding oven on said second pouring tank at a second ladle loading station, when said first ladle is empty of molten metal, transferring said first pouring tank from said pouring station, and then transferring said second pouring tank with said second ladle of molten metal and said second pouring tank cover to said pouring station, further comprising the steps of utilizing a first transfer car to transfer said first pouring tank to said pouring station, and utilizing a second transfer car to transfer said second pouring tank to said pouring station.

2. The method of claim 1 wherein said first pouring tank cover is placed on said first pouring tank at a first ladle-loading station by the use of a crane, and said second pouring tank cover is placed on said second pouring tank at a second ladle-loading station by the use of said crane.

* * * * *